United States Patent [19]

Tsubouchi et al.

[11] Patent Number: 4,556,503

[45] Date of Patent: Dec. 3, 1985

[54] TRACTION DRIVE FLUIDS

[75] Inventors: Toshiyuki Tsubouchi, Sodegaura; Hitoshi Hata, Ichihara, both of Japan

[73] Assignee: Idemitsu Kosan Company Limited, Tokyo, Japan

[21] Appl. No.: 647,110

[22] Filed: Sep. 4, 1984

[30] Foreign Application Priority Data

Sep. 9, 1983 [JP] Japan ..... 58-165064
Apr. 27, 1984 [JP] Japan ..... 59-83845

[51] Int. Cl.[4] ..... C07C 13/00; F16H 15/08

[52] U.S. Cl. ..... 252/73; 252/9; 585/20; 585/21; 585/360

[58] Field of Search ..... 252/9, 73; 585/20, 21, 585/360

[56] References Cited

U.S. PATENT DOCUMENTS 2,622,110 12/1952 Ipatieff et al. ..... 585/20
3,440,894 4/1969 Hammann et al. ..... 252/52 R
4,329,529 5/1982 Nambu ..... 585/20

*Primary Examiner*—A. Lionel Clingman
*Assistant Examiner*—Robert A. Wax
*Attorney, Agent, or Firm*—Walter H. Schneider

[57] ABSTRACT

A traction drive fluid is described, containing as the base stock a compound represented by the general formula (I):

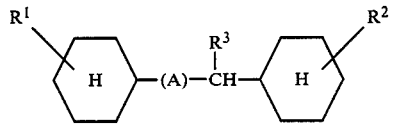

(I)

wherein all the symbols are as defined in the appended claims. This traction drive fluid has a high traction coefficient, has a good thermal stability, is of low viscosity, is of low volatility and further is reduced in temperature dependency of viscosity. Thus it is suitable for use in continuously variable transmission of cars or industrial machines.

20 Claims, No Drawings

TRACTION DRIVE FLUIDS

BACKGROUND OF THE INVENTION

The present invention relates to traction drive fluids. More particularly, it is concerned with traction drive fluids which are of low viscosity, are of low volatility, have a high traction coefficient, have a good thermal stability, and are reduced in temperature dependency of viscosity and, therefore, which are suitable for use in continuously variable transmission of cars or industrial machines.

The term "traction drive fluid" as used herein means a fluid to be used in a traction drive (friction driving equipment utilizing rolling contact), such as a continuously variable transmission for cars or industrial machines, and a hydraulic machine. It is required for these traction drive fluids to have a high traction coefficient, high stability against heat and oxidation and, furthermore, to be inexpensive.

In recent years, the traction drive has been reduced in size and has often been used under high load conditions. In cases that the traction drive is used under such severe conditions, it is necessary to employ traction drive fluids which can exhibit satisfactory performance under various temperature conditions.

Various traction drive fluids have been proposed, including those as described in Japanese Patent Publication Nos. 338/1971, 339/1971, 35763/1972, 42067/1973, 42068/1973, 36105/1978, Japanese Patent Application Laid-Open Nos. 43108/1980, and 40726/1980. These traction drive fluids, however, have disadvantages in that viscosity is relatively high, causing a reduction in power transmission efficiency due to loss of stirring, and temperature dependency of viscosity is high. Various low viscosity compounds have been proposed in Japanese Patent Publication No. 339/1971. But these are not suitable for the lubricants due to these high volatility as these have low boiling points (e.g., dicyclohexylmethane: viscosity at 100° F. 4.03 cSt, boiling point 250° C.; 1,1-dicyclohexylethane: viscosity at 100° F. 5.54 cSt, boiling point 260° C., etc.)

It is necessary for the lubricants to have a boiling point over 300° C. There haven't been yet, proposed traction drive fluids which have both low viscosity and low volatility. Thus it has been desired to develop traction drive fluids which are suitable for use in the traction drive.

SUMMARY OF THE INVENTION

The object of the present invention is to provide a traction drive fluid which has a high traction coefficient, is of low viscosity, is of low volatility, has a good thermal stability, and is reduced in temperature dependency of viscosity.

It has been found that the object is attained by using compounds represented by the general formula (I) as described below as the base stock.

The present invention relates to a traction drive fluid containing as the base stock a compound represented by the general formula (I):

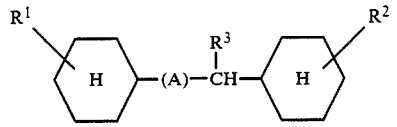

(I)

wherein (A) is a methylethylene group, an ethylethylene group, or an isopropylidene group, and $R^1$, $R^2$ and $R^3$ are each a hydrogen atom, a methyl group, or an ethyl group.

DETAILED DESCRIPTION OF THE INVENTION

The methylethylene group represented by (A) in the general formula (I) is also called a propylene group and has the following formula:

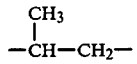

The ethylethylene group has the formula:

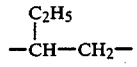

and the isopropylidene group has the formula:

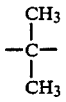

When (A) is a propylidene group, for example, the general formula (I) can be rewritten as follows:

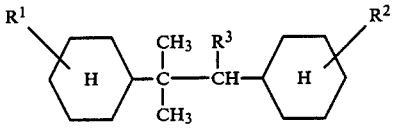

(II)

wherein $R^1$, $R^2$ and $R^3$ are the same as defined above.

Representative examples of the compounds represented by the general formula (II) are shown below.

2-Methyl-1,2-di(cyclohexyl)propane represented by the formula (III):

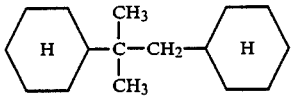

(III)

2-Methyl-1,2-di(methylcyclohexyl) propane represented by the formula (IV):

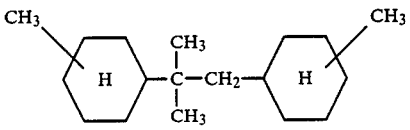

(IV)

2-Methyl-2,3-di(methylcyclohexyl) butane represented by the formula (V):

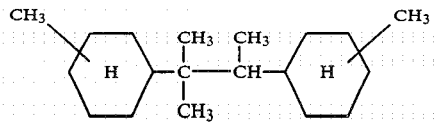

(V)

2-Methyl-1,2-di(ethylcyclohexyl) propane represented by the formula (VI):

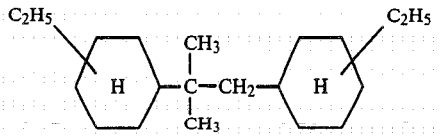

(VI)

When (A) is a methylethlene group, the general formula (I) can be rewritten as follows:

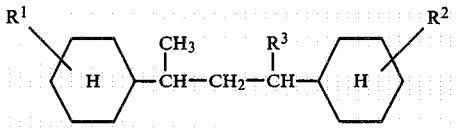

(VII)

wherein $R^1$, $R^2$ and $R^3$ are the same as defined above.

Representative examples of the compounds represented by the general formula (VII) are shown below.

2,4-Dicyclohexylpentane represented by the formula (VIII):

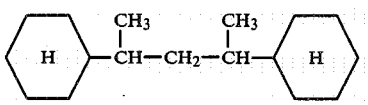

(VIII)

2,4-Dicyclohexylhexane represented by the formula (IX):

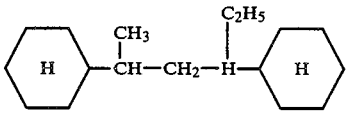

(IX)

When (A) is an ethylethylene group, a typical example is 3,5-dicyclohexylheptane represented by the formula (X):

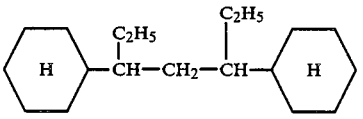

(X)

In the present invention, the above compounds are used, singly or in combination with each other, as the base stock of the traction drive fluid.

The compounds of the general formula (I) are not critical in their method of preparation and can be prepared by various procedures.

For example, the compounds of the general formula (II) can be prepared by reacting benzene, toluene, or ethylbenzene, for example, with methallyl chloride, prenyl chloride, or isoprene at −30° to 80° C. in the presence of a Friedel-Crafts Catalyst, such as aluminum chloride, ferric chloride, stannic chloride, boron trifluoride, hydrogen fluoride, and sulfuric acid and, thereafter, hydrogenating the reaction product. In this case, the hydrogenation conditions vary over a wide range depending on the starting material, the type of the catalyst, and so forth. Usually the temperature is chosen within the range of from room temperature to 300° C., and the hydrogen pressure, within the range of from 1 to 100 atmospheric pressures. As hydrogenation catalysts, known catalysts containing such metals as platinum, palladium, rhodium, ruthenium, nickel, and molybdenum can be used.

The compounds of the general formula (VII) and the formula (X) can be prepared, for example, by reacting alkylbenzene (e.g., ethylbenzene and n-propylbenzene) with α-alkylstyrene (e.g., α-methylstyrene and α-ethylstyrene) in the presence of metallic sodium and then hydrogenating the reaction product in the presence of a hydrogenation catalyst. The reaction between alkylbenzene and α-alkylstyrene can be carried out under any suitable conditions, usually within the temperature range of from 50° to 150° C. in the presence of basic catalyst (e.g., metallic sodium and potassium). The hydrogenation conditions also vary over a wide range depending on the starting material, the type of the catalyst, and so forth. Usually the hydrogenation is carried out at a temperature of from room temperature to 300° C. under a hydrogen pressure of from atmospheric pressure to 200 kilograms per square centimeter (by gauge).

The traction drive fluid of the present invention, as described above, contains as the base stock one or more of the compounds represented by the general formula (I). The traction drive fluid of the present invention have various advantages over conventional traction drive fluids.

Some of the major advantages are shown below.

(1) The traction drive fluid of the present invention has a high traction coefficient and, furthermore, its stability against oxidation and heat is satisfactory.

(2) The compounds of the general formula (I) can be prepared relatively inexpensively by the above-described methods, for example. Thus the traction drive fluid of the present invention is inexpensive and thus is advantageous from an economic standpoint.

(3) Because of low viscosity, the traction drive fluid of the present invention does not cause a reduction in power transmission efficiency due to loss of stirring. Furthermore, it can be used as a diluent for other high viscosity traction drive fluids.

(4) The traction drive fluid of the present invention is superior in power transmission efficiency.

(5) The traction drive fluid of the present invention has a high viscosity index, i.e., is reduced in temperature dependency of viscosity.

Thus the traction drive fluid of the present invention can be widely used in machines such as continuously variable transmission of cars, and hydraulic machines.

The present invention is described in greater detail with reference to the following Examples and Comparative Examples.

EXAMPLE 1

A 3-liter flask was charged with 1,564 grams of toluene and 40 grams of anhydrous aluminum chloride, and a mixture of 272 grams of methallyl chloride and 92 grams of toluene was gradually added dropwise at room temperature over 5 hours while stirring. They were further reacted for 1 hour while stirring. Then, 500 milliliters of water was added to decompose aluminum chloride. The resulting oil layer was separated, washed three times with 1 liter of a 1 normal aqueous solution of sodium hydroxide and also three times with 1 liter of a saturated sodium chloride solution (brine), and then dried over anhydrous sodium sulfate. The unreacted toluene was removed by distillation. The residue was distilled under reduced pressure to yield 500 grams of a fraction having a boiling point range of from 106° to 113° C./0.16 mmHg (from 320° to 330° C./760 mmHg). The main component of the fraction was 2-methyl-1,2-di(p-tolyl)propane.

This fraction (500 grams) was placed in a 1-liter autoclave, and 50 grams of a nickel catalyst (N-113 produced by Nikki Kagaku Co., Ltd.) was added thereto. The fraction was hydrogenated for 3 hours at a temperature of 200° C. under a hydrogen pressure of 50 kilograms per square centimeter (by gauge). A light fraction was removed from the reaction product by stripping, and the resulting residual oil was analyzed. This analysis showed that a degree of hydrogenation was 99.9% or more and the main component was 2-methyl-1,2-di(methylcyclohexyl)propane.

Specific gravity: 0.88 (15/4° C.)

Dynamic viscosity: 10.7 centistokes at 40° C. and 2.41 centistokes at 100° C.

Viscosity index: 6

Traction coefficient at a viscosity of 20 centistokes: 0.087

The traction coefficient was measured by the use of a two roller machine. One of the two rollers of the same size (diameter: 60 millimeters; thickness: 6 millimeters), which were in contact with each other along a line, was rotated at a constant rate (2,000 revolutions per minute), and the other was rotated at a slower constant rate (1,700 revolutions per minute). A load of 140 kilograms was applied on the contact area between the rollers by means of a spring, and the torque was measured by the use of a strain gauge and a torque meter. On basis of the value of the torque, the traction coefficient was determined. The rollers were made of carbon steel SCM-3, and the surface was buffed with alumina (0.03 micron). The surface roughness Rmax was 0.2 micron, and the Herzian contact pressure was 75 kilograms per square millimeter. The viscosity of the oil used was adjusted to 20 centistokes by controlling its temperature.

EXAMPLE 2

A 5-liter flask was charged with 3,500 grams of toluene and 300 grams of concentrated sulfuric acid, and a mixture of 450 grams of isoprene and 200 grams of toluene was gradually added dropwise over 8 hours at 0° C. while stirring. Then the mixture was further stirred at 0° C. for 1 hour. The resulting oil layer was separated, washed three times with 1 liter of a 1 normal aqueous solution of sodium hydroxide and also three times with 1 liter of a saturated sodium chloride solution (brine), and then dried. The unreacted toluene was removed by distillation and, thereafter, a light fraction was removed by distillation under reduced pressure (boiling point: 320° to 360° C./760 mmHg).

The above-obtained product (500 grams) was placed in a 1-liter autoclave, and 50 grams of a nickel catalyst (N-113 produced by Nikki Kagaku Co., Ltd.) was added. The product was hydrogenated for 3 hours at a temperature of 200° C. under a hydrogen pressure of 50 kilograms per square centimeter. A light fraction was removed from the reaction product by stripping, and the resulting residual oil was analyzed. This analysis showed that a degree of hydrogenation was 99.9% or more and the main component was 2-methyl-2,3-di(methylcyclohexyl)butane.

Specific gravity: 0.89 (15/4° C.)

Dynamic viscosity: 26.8 centistokes at 40° C. and 3.8 centistokes at 100° C.

Viscosity index: −78

Traction coefficient at a viscosity of 20 centistokes: 0.088

EXAMPLE 3

A 5-liter glass flask was charged with 2,700 grams of ethylbenzene, 58 grams of metallic sodium, and 17 grams of isopropyl alcohol, and a mixture of 1,100 grams of α-methylstyrene and 300 grams of ethylbenzene was gradually added dropwise over 5 hours while heating at 120° C. and stirring. Then the mixture was further reacted for 1 hour while stirring.

After the reaction was completed, the reaction mixture was cooled, and the resulting oil layer was separated and recovered. To this oil layer was added 200 grams of methyl alcohol, and the resulting mixture was washed three times with 2 liters of a 5 normal aqueous solution of hydrochloric acid and also three times with 2 liters of a saturated sodium chloride solution (brine). The mixture was then dried over anhydrous sodium sulfate. The unreacted ethylbenzene was distilled away by means of a rotary evaporator, and the residue was distilled under reduced pressure to yield 1,500 grams of a fraction having a boiling point range of from 104° to 110° C. at 0.06 mmHg (from 330° to 340° C./760 mmHg). An analysis showed that the fraction was 2,4-diphenylpentane.

This fraction (500 grams) was placed in a 1-liter autoclave, and 20 grams of a hydrogenation nickel catalyst (N-113 produced by Nikki Kagaku Co., Ltd.) was added. The fraction was hydrogenated at a temperature of 200° C. under a hydrogen pressure of 50 kilograms per square centimeter (by gauge). After the reaction was completed, the catalyst was removed and a light fraction was removed from the reaction product by stripping, and the resulting residual oil was analyzed. The analysis showed that a degree of hydrogenation was 99.9% and the hydrogenation product was 2,4-dicyclohexylpentane.

Specific gravity: 0.89 (15/4° C.)

Dynamic viscosity: 11.5 centistokes at 40° C. and 2.69 centistokes at 100° C.

Viscosity index: 52

Traction coefficient: 0.086

This 2,4-dicyclohexylpentane was tested for heat stability according to JIS-K-2540 (170° C., 24 hours). Formation of sludge was not observed at all, and also a change in color was not observed.

COMPARATIVE EXAMPLE 1 p-Methylstyrene (1,200 milliliters) and 300 milliliters of 55% sulfuric acid were placed in a 3-liter glass flask and reacted at 110° C. for 2 hours while stirring. At the end of the period, the reaction mixture was allowed to stand and to separate into a water layer and an oil layer. The oil layer was washed three times with 1 liter of a 3% aqueous solution of sodium hydroxide and also three times with 1 liter of a saturated sodium chloride solution (brine), and then dried over anhydrous sodium sulfate. The unreacted p-methylstyrene was distilled away. The residue was distilled under reduced pressure to yield 600 grams of a fraction having a boiling point of 144°–153° C./0.2 mmHg (from 360° to 370° C./760 mmHg). This fraction was found to be a mixture of 98% of a linear dimer of p-methylstyrene and 2% of a cyclic dimer of p-methylstyrene.

This fraction was hydrogenated in the same manner as in Example 1, thereby producing a traction drive fluid composed mainly of a hydrogenated product of the p-methylstyrene linear dimer.

The properties of the above-hydrogenated product were as follows:

Specific gravity: 0.88 (15/4° C.)

Dynamic viscosity: 11.4 centistokes at 40° C. and 2.6 centistokes at 100° C.

Viscosity index: 26

Traction coefficient at a viscosity of 20 centistokes: 0.077

Although the product was similar in chemical structure to the compounds of the present invention, it was found to be low in traction coefficient as compared with the compounds of the present invention.

COMPARATIVE EXAMPLE 2

Phenylcyclohexane (800 grams), 200 grams of n-hexane, and 300 grams of concentrated sulfuric acid were placed in a 3-liter glass flask and cooled down to 0° C. While maintaining the reaction temperature at 0° C. and stirring, 260 grams of styrene was added dropwise over 3 hours, and they were further reacted for 1 hour while stirring. Then the reaction mixture was allowed to stand and to separate into a sulfuric acid layer and an oil layer. The oil layer was washed three times with 1 liter of a 3% aqueous solution of sodium hydroxide and also three times with 1 liter of a saturated sodium chloride solution (brine), and then dried over anhydrous sodium sulfate. The n-hexane solvent and the unreacted phenylcyclohexane were distilled away. The residue was distilled to yield 520 g of a fraction having a boiling point of 130°–143° C./0.15 mmHg (from 350° to 370° C./760 mmHg).

This fraction was analyzed and found to be 1-phenyl-1-(cyclohexylphenyl)ethane.

The fraction was hydrogenated in the same manner as in Example 1 to yield 1-cyclohexyl-1-(dicyclohexyl)ethane. The properties of this compound were as follows:

Specific gravity: 0.93 (15/4° C.)

Dynamic viscosity: 68.0 centistokes at 40° C. and 6.57 centistokes at 100° C.

Viscosity index: −6

Traction coefficient at a viscosity of 20 centistokes: 0.084

It can be seen that the traction coefficient of the present compound is nearly equal to that of the compound of the present invention, but its viscosity is high.

What is claimed is:

1. A process for improving the coefficient of traction between at least two relatively rotatable elements in a torque transmitting relationship and for maintaining said coefficient of traction substantially constant over a broad range of operating temperatures which comprises introducing between the tractive surfaces of said elements a traction drive fluid comprising as the active component at least one compound represented by the general formulae A and B:

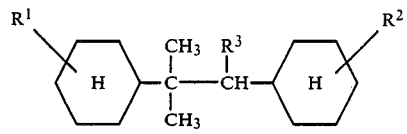

(A)

wherein $R^1$, $R^2$ and $R^3$ are each a hydrogen or a methyl or an ethyl group,

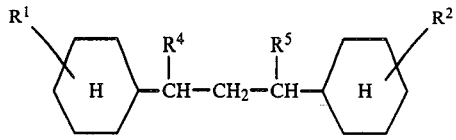

(B)

wherein $R^1$ and $R^2$ are the same as defined above, and $R^4$ and $R^5$ are each a methyl or an ethyl group.

2. A process according to claim 1 in which said active component comprises at least one compound represented by the general formula (A).

3. A process according to claim 2 in which said compound represented by the general formula (A) is 2-methyl-1,2-di(cyclohexyl)propane having the formula (III):

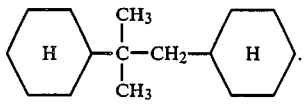

(III)

4. A process according to claim 2 in which said compound represented by the general formula (A) is 2-methyl-1,2-di(methylcyclohexyl)propane having the formula (IV):

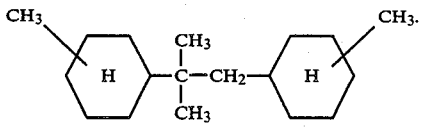

(IV)

5. A process according to claim 2 in which said compound represented by the general formula (A) is 2-methyl-2,3-di(methylcyclohexyl) butane having the formula (V):

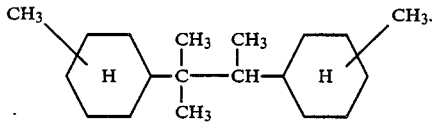

(V)

6. A process according to claim 2 in which said compound represented by the general formula (A) is 2-methyl-1,2-di(ethylcyclohexyl)propane having the formula (VI):

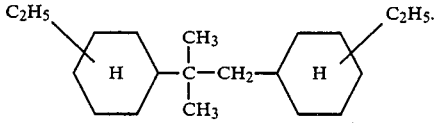

(VI)

7. A process according to claim 1 in which said active component comprises at least one compound represented by the general formula (B).

8. A process according to claim 7 in which said compound represented by the general formula (B) is 2,4-dicyclohexylpentane having the formula (VIII):

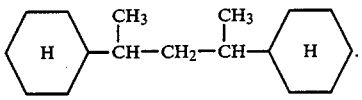

(VIII)

9. A process according to claim 7 in which said compound represented by the general formula (B) is 2,4-dicyclohexylhexane having the formula (IX):

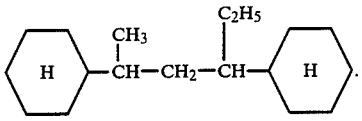

(IX)

10. A process according to claim 7 in which said compound represented by the general formula (B) is 3,5,-dicyclohexylheptane having the formula (X):

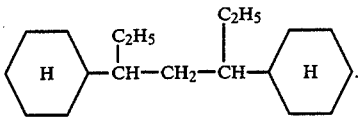

(X)

11. A traction drive fluid composition for use between two relatively rotatable elements in a torque transmitting relationship which comprises as the active component at least one compound represented by the general formulae (A) and (B):

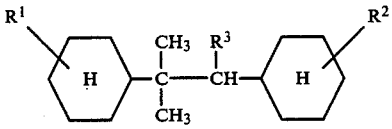

(A)

wherein $R^1$, $R^2$ and $R^3$ are each a hydrogen or a methyl or an ethyl group,

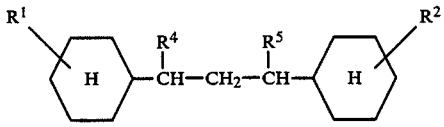

(B)

wherein $R^1$ and $R^2$ are the same as defined above, and $R^4$ and $R^5$ are each a methyl or an ethyl group.

12. A traction drive fluid composition according to claim 11 in which said active component comprises at least one compound represented by the general formula (A).

13. A traction drive fluid composition according to claim 12 in which said compound represented by the general formula (A) is 2-methyl-1,2-di(cyclohexyl)propane having the formula (III):

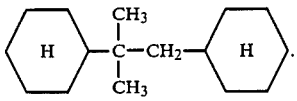

(III)

14. A traction drive fluid composition according to claim 12 in which said compound represented by the general formula (A) is 2-methyl-1,2-di(methylcyclohexyl)propane having the formula (IV):

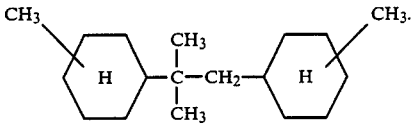

(IV)

15. A traction drive fluid composition according to claim 12 in which said compound represented by the general formula (A) is 2-methyl-2,3-di(methylcyclohexyl)butane having the formula (V):

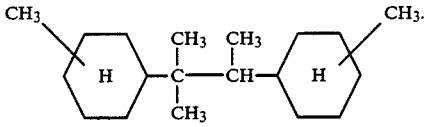

(V)

16. A traction drive fluid compositon according to claim 12 in which said compound represented by the general formula (A) is 2-methyl-1,2-di(ethylcyclohexyl)propane having the formula (VI):

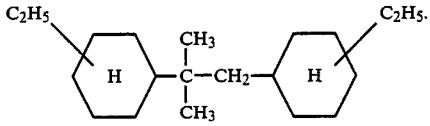

(VI)

17. A traction drive fluid composition according to claim 11 in which said active component comprises at least one compound represented by the general formula (B).

18. A traction drive fluid composition according to claim 17 in which said compound represented by the general formula (B) is 2,4-dicyclohexylpentane having the formula (VIII):

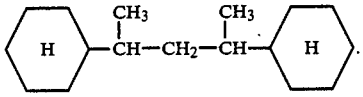

(VIII)

19. A traction drive fluid composition according to claim 17 in which said compound represented by the general formula (B) is 2,4-dicyclohexylhexane having the formula (IX):

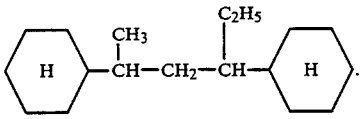

(IX)

20. A traction drive fluid composition according to claim 17 in which said compound represented by the general formula (B) is 3,5-dicyclohexylheptane having the formula (X):

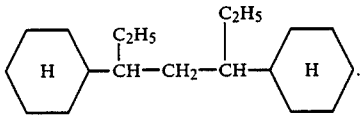

(X)

* * * * *